US007384383B2

(12) United States Patent
Forcillo

(10) Patent No.: US 7,384,383 B2
(45) Date of Patent: Jun. 10, 2008

(54) ABDOMINAL BENCH

(75) Inventor: John Forcillo, deceased, late of Laval (CA); by Mary Forcillo, legal representative, Laval (CA)

(73) Assignee: J.E.M. Concept International, Inc. (CA)

( * ) Notice: Subject to any disclaimer, the term of this patent is extended or adjusted under 35 U.S.C. 154(b) by 0 days.

(21) Appl. No.: 11/588,344

(22) Filed: Oct. 27, 2006

(65) Prior Publication Data

US 2007/0099777 A1 May 3, 2007

Related U.S. Application Data

(60) Provisional application No. 60/730,856, filed on Oct. 28, 2005.

(51) Int. Cl.
*A63B 26/00* (2006.01)
*A63B 23/02* (2006.01)

(52) U.S. Cl. ..... 482/140; 482/142

(58) Field of Classification Search ..... 482/97, 482/98, 140, 142, 145, 908
See application file for complete search history.

(56) References Cited

U.S. PATENT DOCUMENTS

| | | | | |
|---|---|---|---|---|
| 4,405,128 | A * | 9/1983 | Mclaughlin et al. | 482/97 |
| 4,627,619 | A * | 12/1986 | Rockwell et al. | 482/137 |
| 5,665,041 | A * | 9/1997 | Hsieh | 482/140 |
| 5,669,865 | A * | 9/1997 | Gordon | 482/142 |
| 5,716,308 | A * | 2/1998 | Lee | 482/130 |
| 5,769,766 | A * | 6/1998 | Huang | 482/140 |
| 5,938,575 | A * | 8/1999 | Stearns | 482/140 |
| 6,168,557 | B1 * | 1/2001 | Liao | 482/140 |
| 6,186,926 | B1 * | 2/2001 | Ellis | 482/97 |
| 6,206,809 | B1 * | 3/2001 | Habing et al. | 482/96 |
| 6,544,154 | B2 * | 4/2003 | Forcillo | 482/142 |
| 6,884,203 | B2 * | 4/2005 | Forcillo | 482/142 |
| 2004/0067829 | A1 * | 4/2004 | Eschenbach | 482/140 |

* cited by examiner

*Primary Examiner*—Loan H. Thanh
*Assistant Examiner*—Oren I Ginsberg
(74) *Attorney, Agent, or Firm*—Davidson Berquist Jackson & Gowdey LLP

(57) ABSTRACT

An improved abdominal bench having a simplified structure, a more comprehensive weight system, a multi-positional foot assembly and a more streamlined frame and pivoting linkages.

10 Claims, 13 Drawing Sheets

ABDOMINAL BENCH

CROSS-REFERENCE TO RELATED APPLICATIONS

This application claims the benefit under 35 USC 119(e) of U.S. Provisional Application Ser. No. 60/730,856 filed Oct. 28, 2005, the entire contents of which are herein incorporated by reference.

DESCRIPTION OF THE INVENTION AND OF THE MANNER AND PROCESS OF MAKING AND USING IT

Field of the Invention

The invention relates to an improved, dual function sit-up and abdominal exercising bench system.

BRIEF DESCRIPTION OF THE DRAWINGS

The present invention, its objectives and advantages will become more apparent from the following detailed description when read in conjunction with the accompanying drawings in which.

BACKGROUND

Reference is hereby made to two of my previous patents relating to abdominal benches, U.S. Pat. No. 6,544,154 (the '154 patent), filed on May 14, 2001, which issued on Apr. 8, 2003, and U.S. Pat. No. 6,884,203 (the '203 patent), filed on May 19, 2003 and issued on Apr. 26, 2005. Both are commonly owned and are hereby incorporated herein in their entirety by reference.

Abdominal benches, or ab benches, have become well known and used within the exercise equipment market. My '154 patent disclosed an ab bench having a minimum number of pivots and a sliding weight that permitted both negative and positive resistance to be obtained by a bench user. My '203 patent, described, in part, an ab bench with multiple pivots that allowed a constant gap to be maintained between the seat and torso cushions during use of the bench. That was accomplished by using a plurality of pivot points around which the torso and its linkage members moved. It also allowed the torso and leg assembly to operate together when desired.

The present abdominal bench exhibits a streamlined construction and its operating linkages have been modified making the bench equally useful yet more desirable by being lighter in weight, having additional features in the foot assembly, in the sliding weight, and in the central moving member.

DETAILED DESCRIPTION

Figure 1:
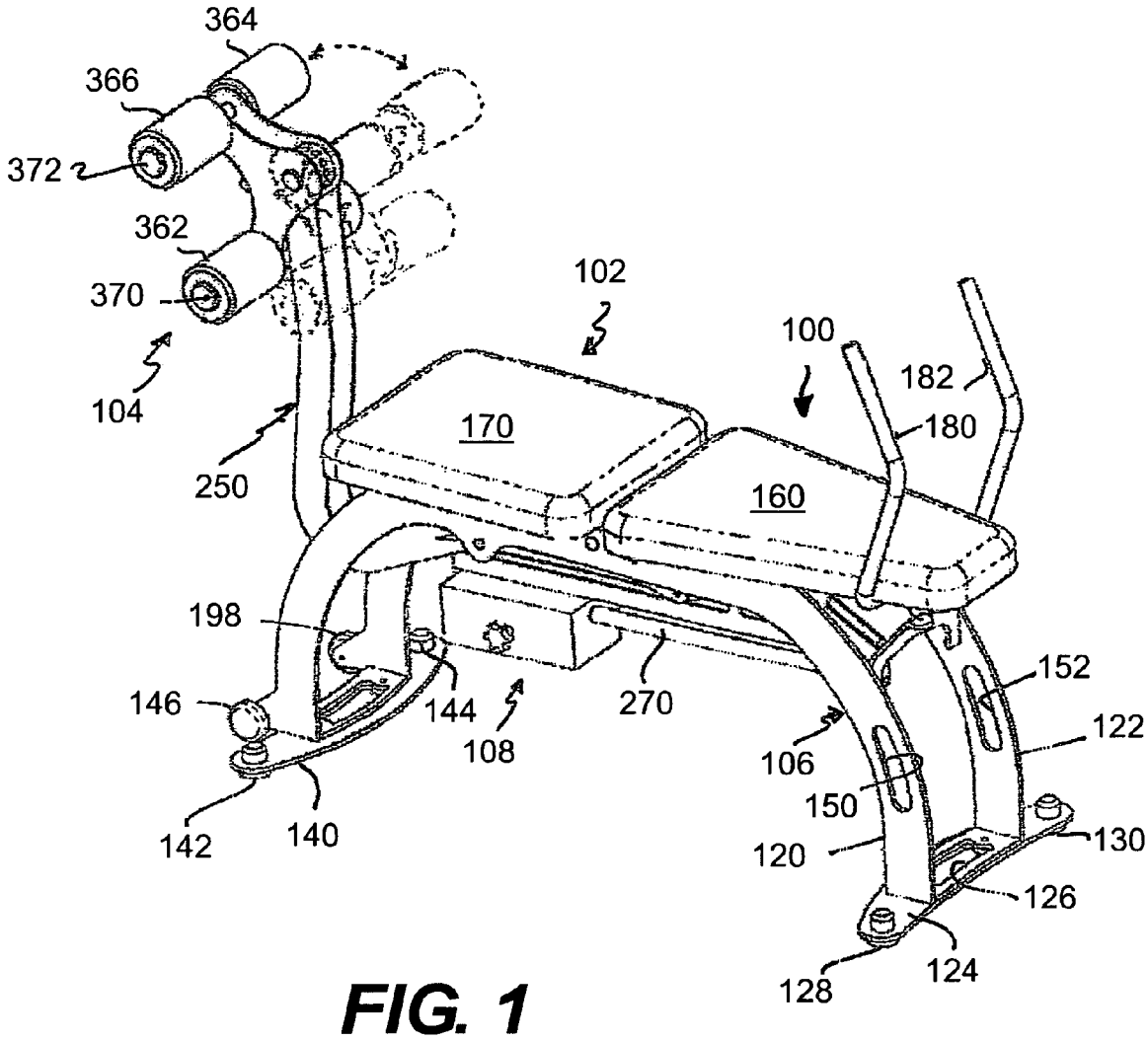
FIG. 1 is a front perspective view of the abdominal bench according to the present invention.

FIG. 1 shows the improved abdominal bench as being comprised of several sections including a torso section 100, a seat section 102, a foot assembly 104, a frame 106, a weight assembly 108 and a linkage section 110.

The frame 106 includes a pair of outer frame elements 120 and 122 that form the main support of the bench as well as the visible outer sides of the bench itself. These are preferably formed from plate stock and have a thickness of about 5'16$^{th}$ inches and a finished height of about 20 inches. As shown in FIGS. 1-4 and 11 each main frame element 120 and 122 has a straight center section and opposing curved end sections. Using plate stock provides sufficient strength yet reduces weight and simplifies both manufacture and assembly. The head or torso end includes a horizontal base 124, which can be welded or attached to each of the frame elements 120 and 122 by bolts or other convenient means, and base 124 includes a cut out portion 126 and a pair of rubber feet 128 and 130. The opposite end of the frame elements 120 and 122 also includes a base 140, a pair of feet 142 and 144, and a pair of rollers 146 and 148 rotatably mounted respectively to frame elements 120 and 122. Each frame piece 120 and 122 also includes a hand gripping cut out 150 and 152, respectively, that permit a user to grab and then pick up the head end of the bench and roll the opposite end on rollers 146 and 148.

Figure 2:
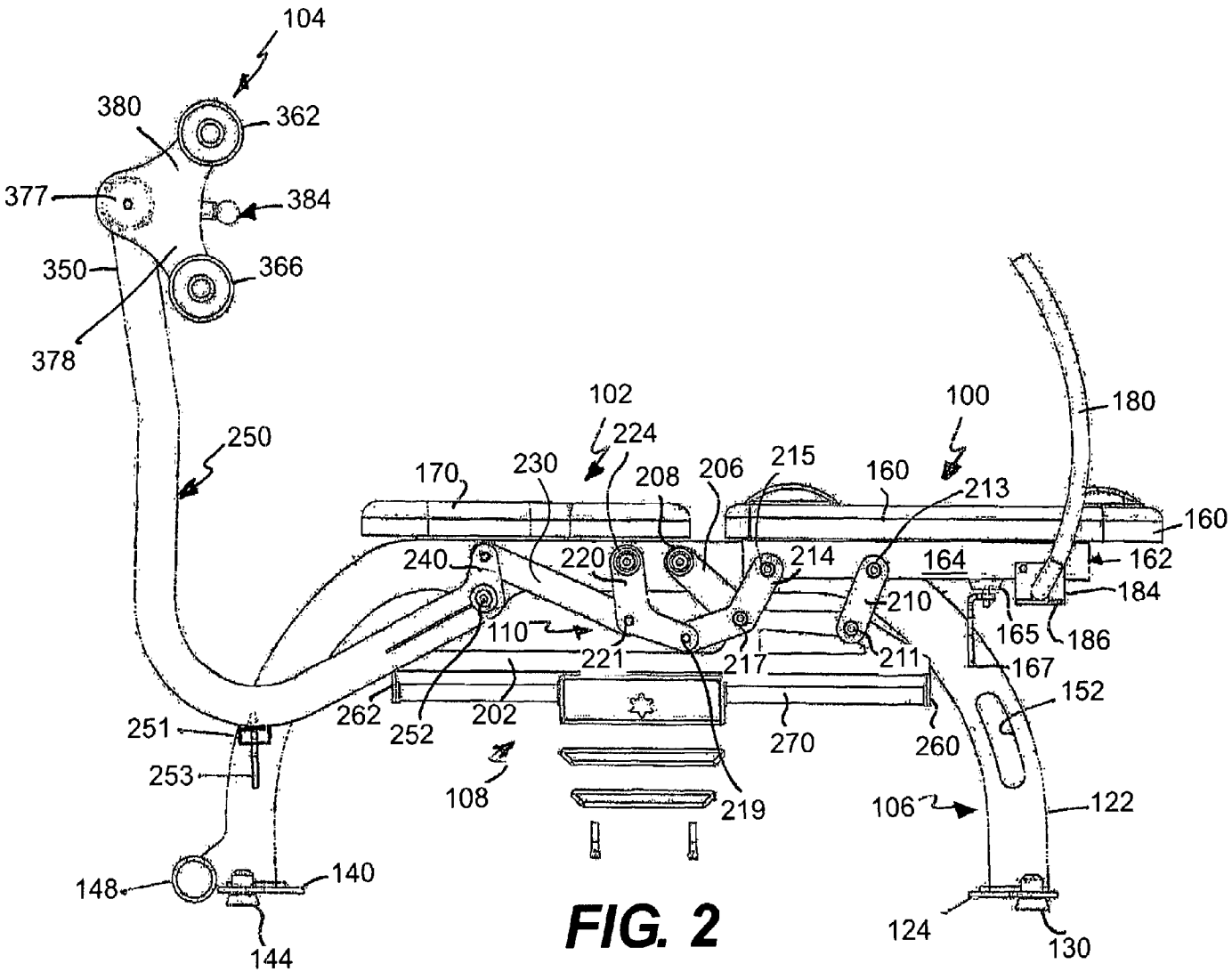
FIG. 2 is a front elevational view thereof in a normal position, with portions taken away for clarity.
Figure 4:
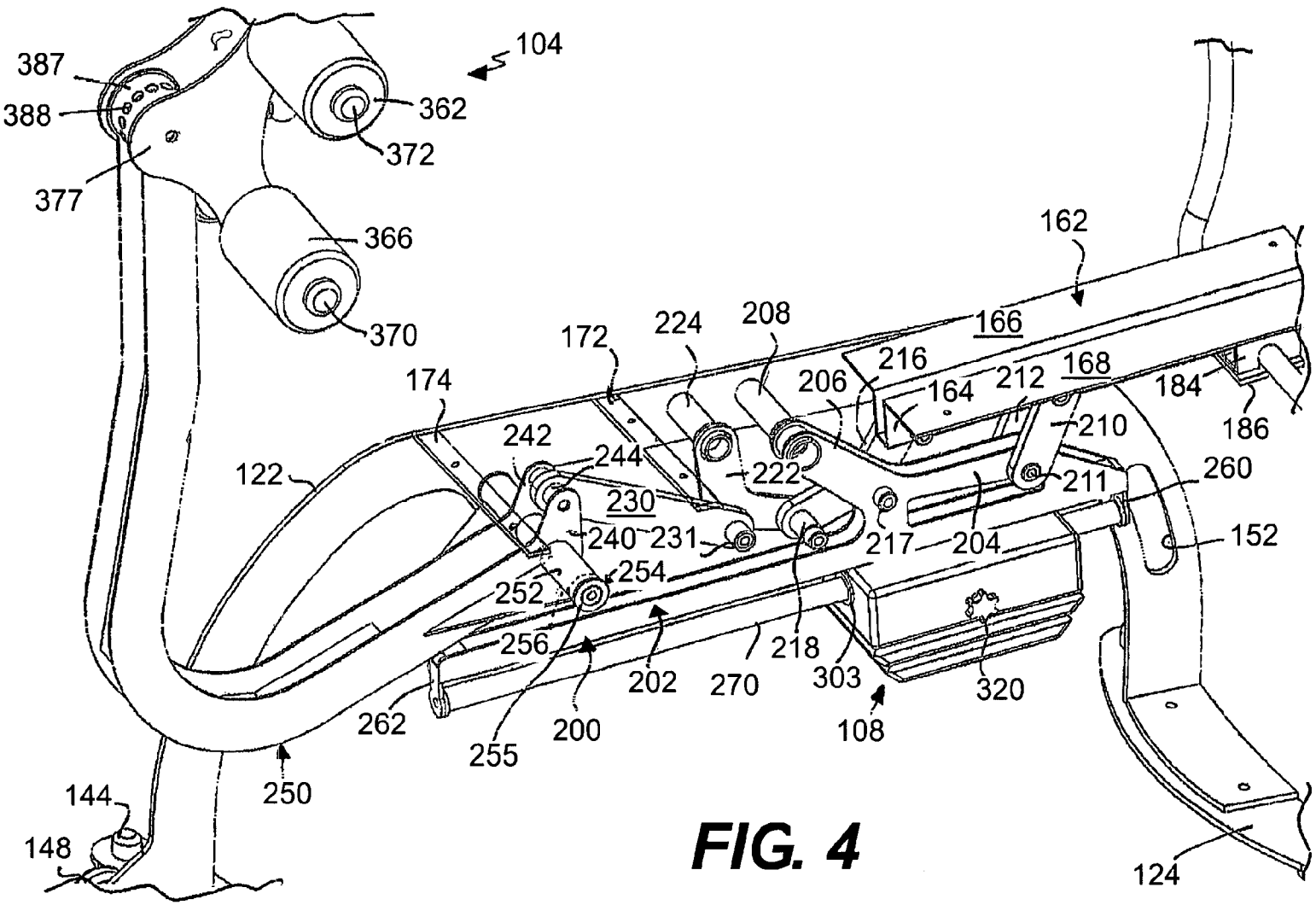
FIG. 4 is an enlarged perspective view if FIG. 2.

The torso section 100 includes a cushion 160 that is retained by a torso support member 162 shown in FIG. 4 as having a central U-shaped channel 164 and two horizontally extending side pieces 166 and 168. The side pieces rest on a stop member 165 that is mounted to frame 122 by a suitable bracket 167 which, as shown in FIG. 2, can extend across and be connected between frames 120 and 122.

The seat 102 also includes a cushion 170 that is held in place, for example, by being screwed to two retainer members 172 and 174 that are welded to or screwed to, and extend across, the two frame elements 120 and 122 as shown in FIG. 4.

Handle bars 180 and 182 are also attached to the torso support 162 by being screwed thereto using a bracket 184 and a plate 186 that is welded to the handle bars.

The linkage assembly 110 begins with a main linkage member 200 that extends axially benesth and along the frame elements 120 and 122, and comprises an elongated foot section 202, and a head end or section 204. The head section 204 includes an angled, main pivot connection arm 206 that extends outwardly at an obtuse angle of about 145° from the rear portion of the head end 204, or at an acute angle of about 45° from the elongated foot section 202 depending upon which angle is being measured. This is best shown in FIG. 4. The distal or outer end of the connection arm 206 is pivotally connected between the frame elements 120 and 122 by being mounted on a cross-beam or pivot tube 208, thus making the center of that cross beam or pivot tube 208 a pivot point, with cross beam 208 being operatively connected by bearings to each of the frame elements 120 and 122 so that the main linkage member 200 is pivotally movable relative to the frame elements 120 and 122.

Figure 5:
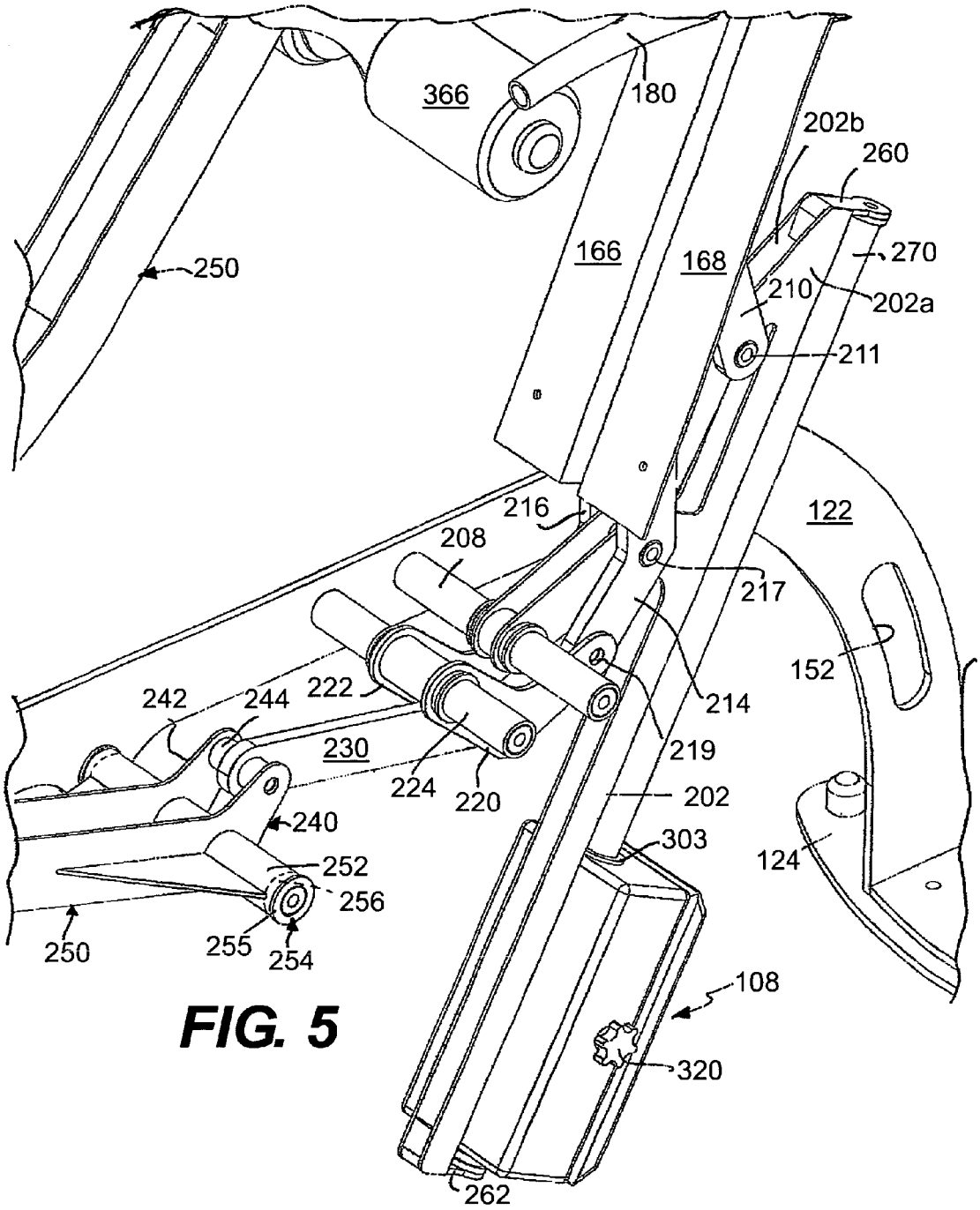
FIG. 5 is an enlarged perspective view of FIG. 3.

The main linkage member 200 is shown in the Figures as being formed from two, plates, for example 202*a* and 202*b* as in FIG. 5, that can be welded together by using suitable welded spacers (not shown). It should be understood, however, that only one of these plates could be used, for example only 202*a* or 202*b*. This would make the bench lighter in weight, yet provide suitable strength to properly allow full operation and use of the bench.

The main linkage member 200 is pivotally connected at two points to the torso support member 162, which collectively comprise a linkage assembly that operatively interconnects the upper torso assembly and the frame. The first of these two pivotal points is comprised of a pair of links 210 and 212 that extend between the upper section 204 and the channel 164 and pivotal connections 211 and 213. These links 210 and 212 can be separate links or they can be interconnected by a cross bar and formed as an H-shaped link. Suitable bearings are used at each of the pivot connections.

The second pivotal connection between the torso support member 162 and the main linkage member 200 is comprised by a pair of boomerang shaped links 214 and 216. These boomerang shaped links 214 and 216 each have three pivot type connection points, one at each end and a third at the center thereof. The upper ends of links 214 and 216 are pivotally connected at a point 215 on the rear end of the torso support member 162. A center point 217 of links 214 and 216 is pivotally connected to the main linkage member 200, at a point near the base of the connection arm 206, that point being about where the connection arm 206 joins the main linkage member 200. The lower ends of each of links 214 and 216 are connected to a cross-bar or pivot tube 218 that is welded, or otherwise operatively mounted between the lower ends of the links 214 and 216 and by bearings pivotally connected at a pivot point 219 to the lower ends of a separate and second pair of boomerang links 220 and 222. The interior angle between the arms of links 214 and 216 is about 60°.

Figure 3:
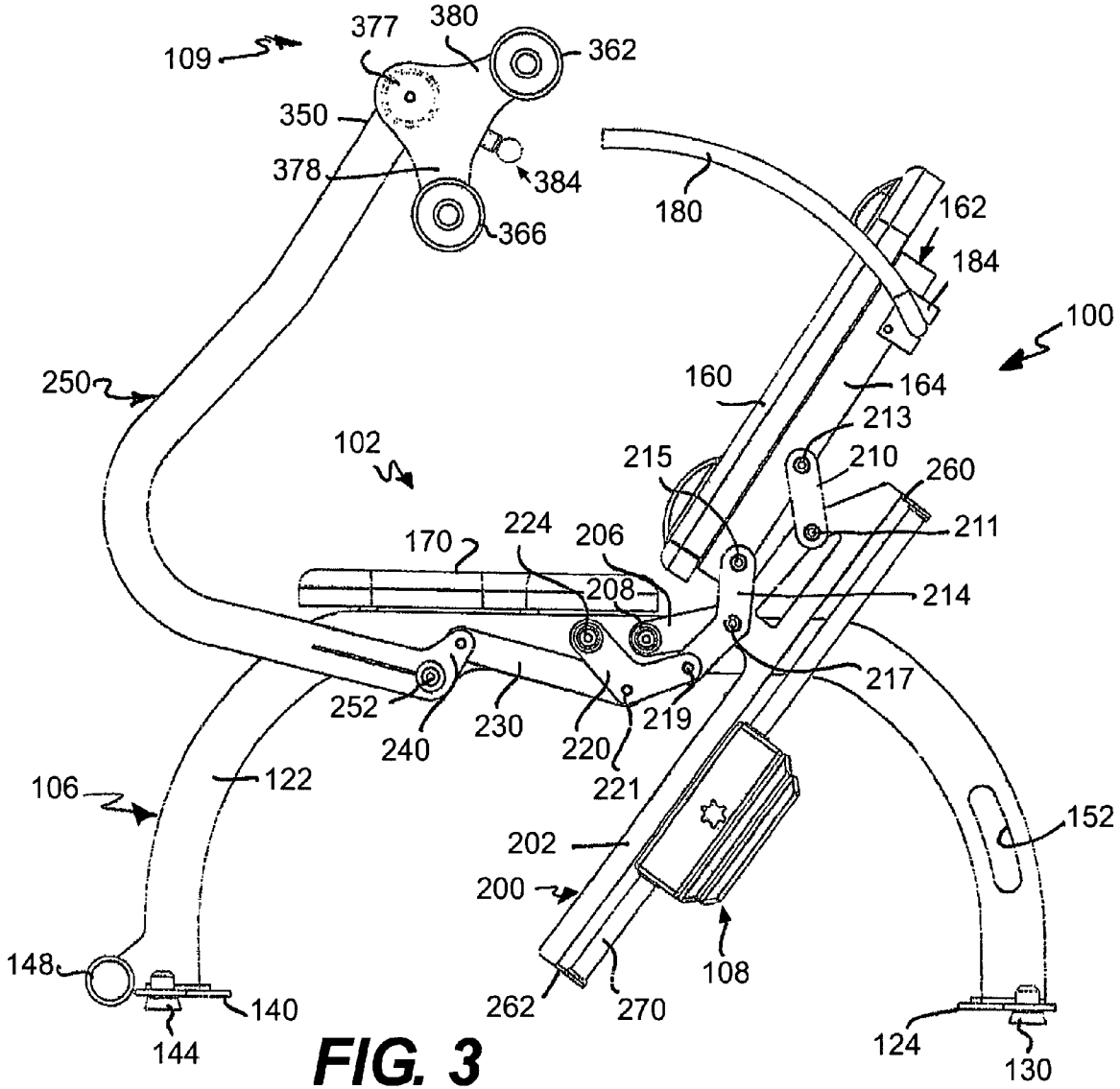
FIG. 3 is a front elevational view thereof in an operated condition, with portions taken away for clarity.

This second pair of boomerang links 220 and 222 are turned backwards relative to boomerang links 214 and 216, and they also have three pivotal connection points, one being at their lower ends at the connection point 219 to the boomerang shaped links 214 and 216. The second connection point for links 220 and 222 is at their center 221 where they are pivotally connected to the head or front end of a hitch member 230 that includes a pivot tube or cross-beam 231 shown in FIG. 4. It should be noted that this head end of hitch member 230 is connected to the central pivot point 221 and that it is not connected to the foot section of the main linkage 200 or to the frame. The third pivotal connection point for links 220 and 222 is at their upper ends where they are connected to a cross-beam or pivot tube 224 that is operatively mounted, by suitable bearings, between the frame elements 120 and 122 just to the rear, which is toward the foot end of the bench, of cross beam 208. This separate set of links 220 and 222 provides a separate pivotal connection between the linkage assembly connecting the torso assembly 100 to the frame members 120 and 122. The torso assembly 100 thus pivots relative to the frame elements 120 and 122 about both cross beams or pivot points 208 and 224, as is shown in FIG. 3. The interior angle between the boomerang arms of links 220 and 222 is about 45°.

The opposite end of hitch member 230 is pivotally connected to an upper part of a pair of mounting wings 240 and 242 by a cross beam 244. The mounting wings 240 and 242 are provided at, and preferably facing upwardly from, an interior end of the main L-shaped foot assembly beam 250 of the foot assembly 104 which is, in turn, pivotally connected by cross beam 252, and by suitable bearings described below, between frame elements 120 and 122. Thus, hitch member 230 interconnects and links the torso section 100 to the foot assembly 104 so that they each interact with the other as the bench is used in crunch exercises. This L-shaped foot assembly beam 250 will rest in its unmoved position on a stop 251 that is connected to a bracket 253 that is welded or otherwise attached between frames 120 and 122.

Figure 14:
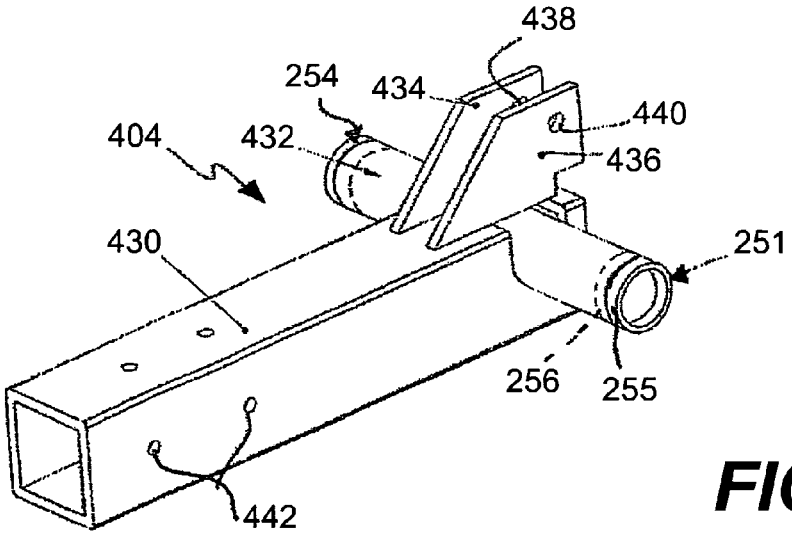
FIG. 14 is a perspective vie of another portion of the foot support tube assembly.

As representative of each of the pivot connections used on the present invention, reference is made to FIGS. 4, 5 and 14. The end of each cross beam, for example 252, includes either a bronze bushing or a bearing member 254 that can, for example, include an outer flange 255, and an internal cylindrical bearing 256 that will fit over a pin or rod type connection, or onto or into a complementary member or connection on the frame member 120 and 122, or another support member. The bearings can be, for example, a DryLin bearing, such as a bearing type TJUM-03 manufactured by IGUS, an R-Linear plain bearing or a split linear bearing. All that is required is that each of the pivot connections be made in a manner that permits the two engaged members to pivot relative to the frame or to a structure on which the pivoting member is attached.

The main linkage member 200 also includes mounting brackets 260 and 262 at opposite ends that support opposite ends of a weight support tube 270 on which the weight assembly 108 is support and on which it can slide.

Figure 6:
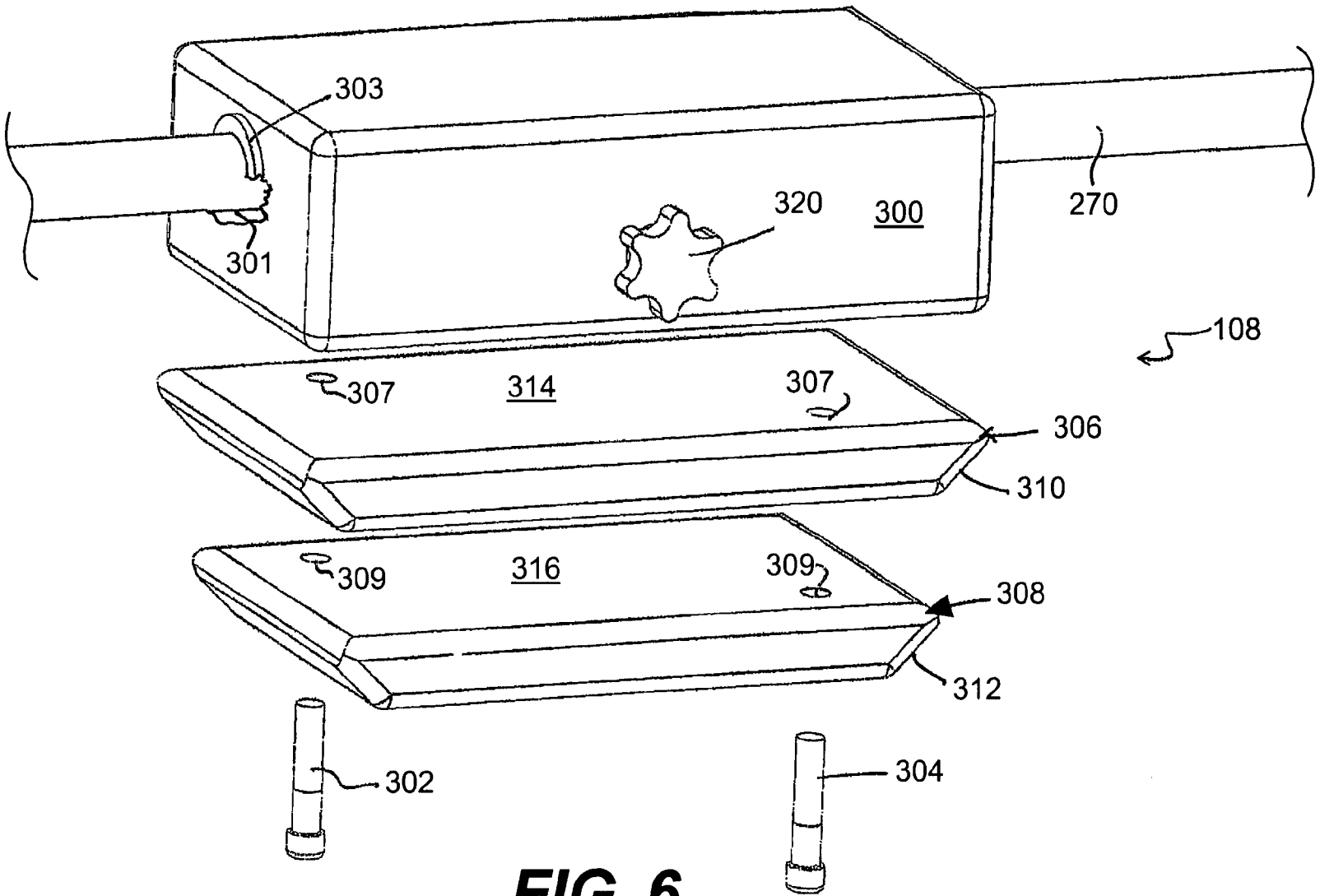
FIG. 6 is an enlarged view of the weight assembly.
Figure 9:
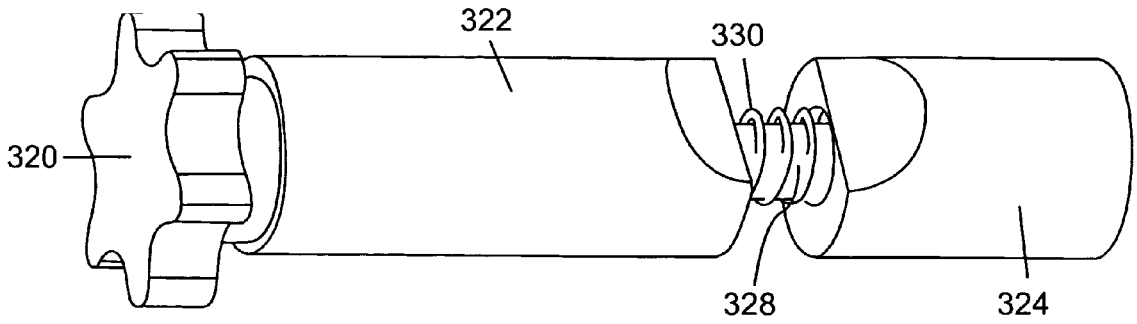
FIG. 9 is a perspective view of the weight locking mechanism.
Figure 10:
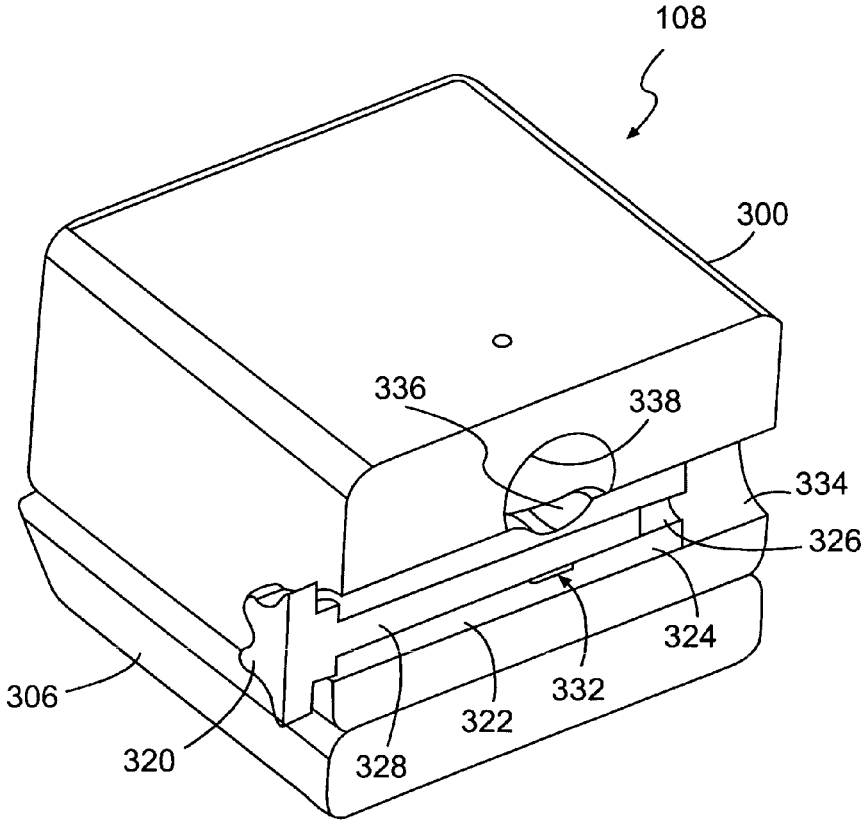
FIG. 10 is a diagrammatic cross-sectional view of the weight assembly as mounted and locked in place.
Figure 11:
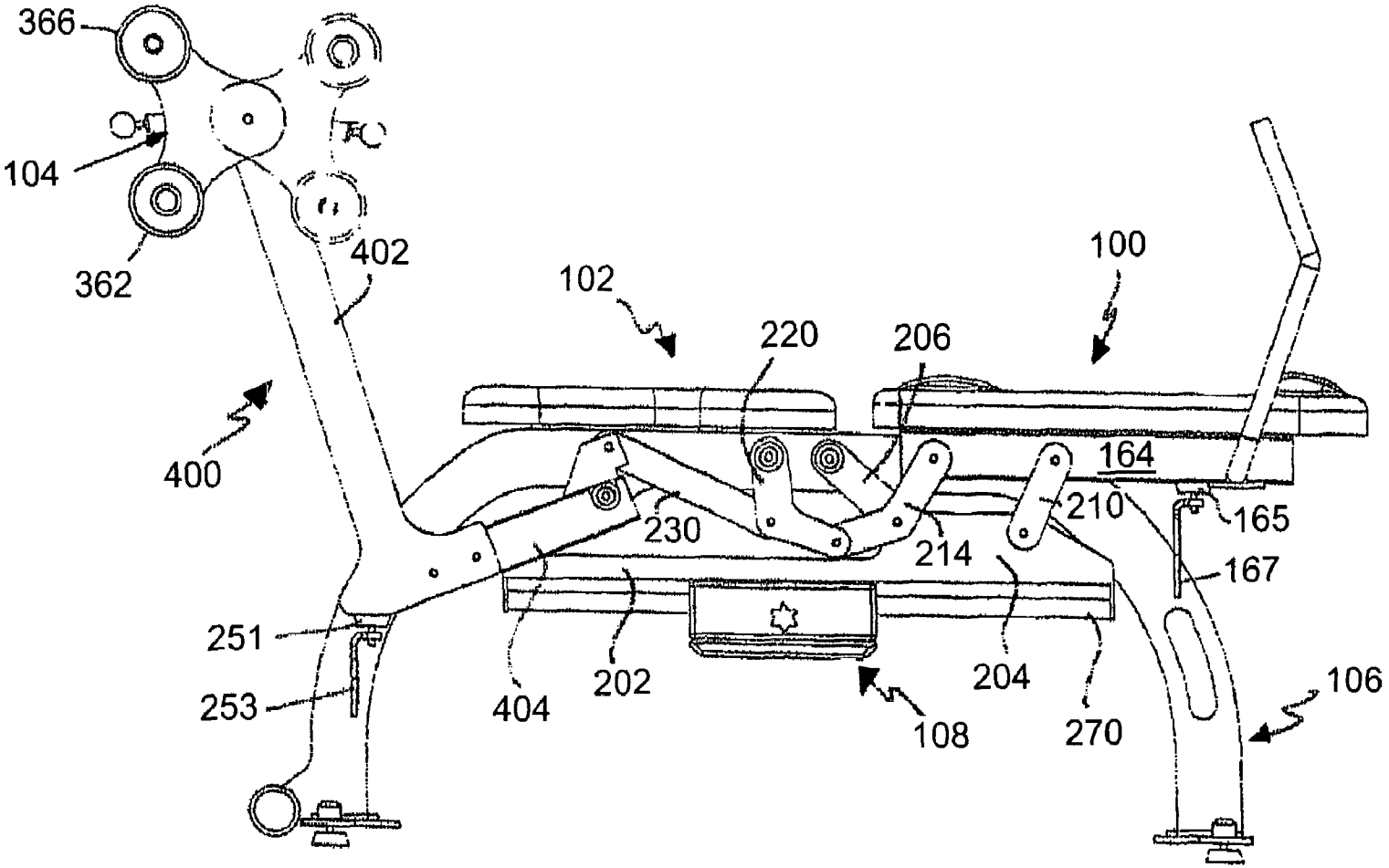
FIG. 11 is a side elevational view of another embodiment of the present invention.

With reference to FIGS. 6, 9 and 10, the sliding weight according to his present invention will be further understood. The concept of using a sliding weight was first disclosed in my '154 patent where that weight had its movement and location controlled by a pin arrangement. The weight could be moved relative to a central torso pivot point, where a weight effect was neutral, so that as the weight was moved on one side or the other of that pivot point either positive resistance or negative resistance weight effects could be established. An earlier version of this sliding weight was also used in my second ab bench patent, the '203 patent where movement and positioning of the weight was controlled by a knob and a pressure plate and in my '154 patent where a push type locking pin was used. Here the weight assembly 108 is further modified by having a plurality of weights, and by an improved and modified locking mechanism.

With reference to FIGS. 2 and 6 the weight assembly 108 is comprised of a main weight 300, which can vary from about 30 pounds to about 45 pounds. This main weight 300 is provided with a through bore 301 through which the support tube 270 passes. In addition, a slide bearing 303 is mounted at each end of the bore 301, and over tube 270, so that weight 300 can easily slide along tube 270. The lower portion of weight 300 can be provided with threaded holes to receive therein bolts 302 and 304 that can be used to mount additional weights, as are shown, for example, at 306 and 308, by passing through apertures 307 and 309, respectively. These extra or add-on weights 306 and 308 can vary in weight from about 10 to 15 pounds each so that, for example, if the main weight was 35 pounds and two 15 pound add-on weights were used the total weight might be 65 pounds. It might be noted that the add-on weights can have beveled outer sides, indicated at 310 and 312 in FIG. 6, so that as the bench is used, and as the torso section 100 moves from a horizontal position as in FIG. 2 to a crunch position and the main linkage member 200 pivots, as in FIG. 3, the weight will not hit the floor as the weight also move along an arc beneath the bench. This assumes that the weight assembly 108 is positioned at its fully negative resistance position at the foot end of the weight support tube 270, adjacent mounting bracket 262. In this regard, the neutral point is located between pivot points 208 and 224. Thus, as the weight assembly is moved toward mounting bracket 262 the weight will provide increasing levels of negative resistance. Conversely, as the weight assembly 108 is moved from the neutral point toward mounting bracket 260 increasing levels of positive resistance will be provided, with the full positive resistance being achieved with weight 300 adjacent mounting bracket 260.

In addition, the add-on weights 306 and 308 have flat upper surfaces, 314 and 316, respectively, to permit a close fitting relationship to one another and to the bottom of the main weight 300.

FIG. 9 shows a new locking mechanism for the weight assembly 108. This locking mechanism includes a knob 320, a first barrel 322, a second barrel 324 having a threaded internal bore 326, a threaded rod 328 and a compression type coil spring 330 that is mounted so as to be effective to operate between the two barrels 322 and 324 in a way that will tend to push them apart. Coil spring is preferably about 1,25 inches long, has an outer diameter of about $7/16^{th}$ inches and an inner diameter of about $3/8^{th}$ inches with a compression of about 17 psi. As shown in FIG. 10, there is a circular recess 332 formed in the facing ends of barrels 322 and 324 in which the spring 330 can be received, and there is a transversely extending bore 334 within weight 300 in which the locking mechanism can be received. The facing ends of the two barrels 322 and 324 also include a semi-circular cut out area 336 that will mirror, and fit around, the outer circumference of the weight support tube 270. FIG. 10 also shows that the main weight 300 includes a hole 338 that extends down the axial length of weight 300 and above the transversely extending bore 326. The support tube 270 fits within bore 336 in a sliding manner. FIG. 10 shows the second barrel 324 filly closed against barrel 322. In use, the second barrel 324 would be located further away from barrel 322 so that the semi-circular cut out in barrel 324 was aligned with the bore 326. Once tube 270 was within bore 326, knob 320 will be turned which turns the treaded rod 328 in barrel 324. This will pull barrel 324 toward the knob 320 until the semi-circular cut out fits tightly against the exterior of tube 270 thereby locking the weight assembly in a selected position on the tube 270.

Figure 7:
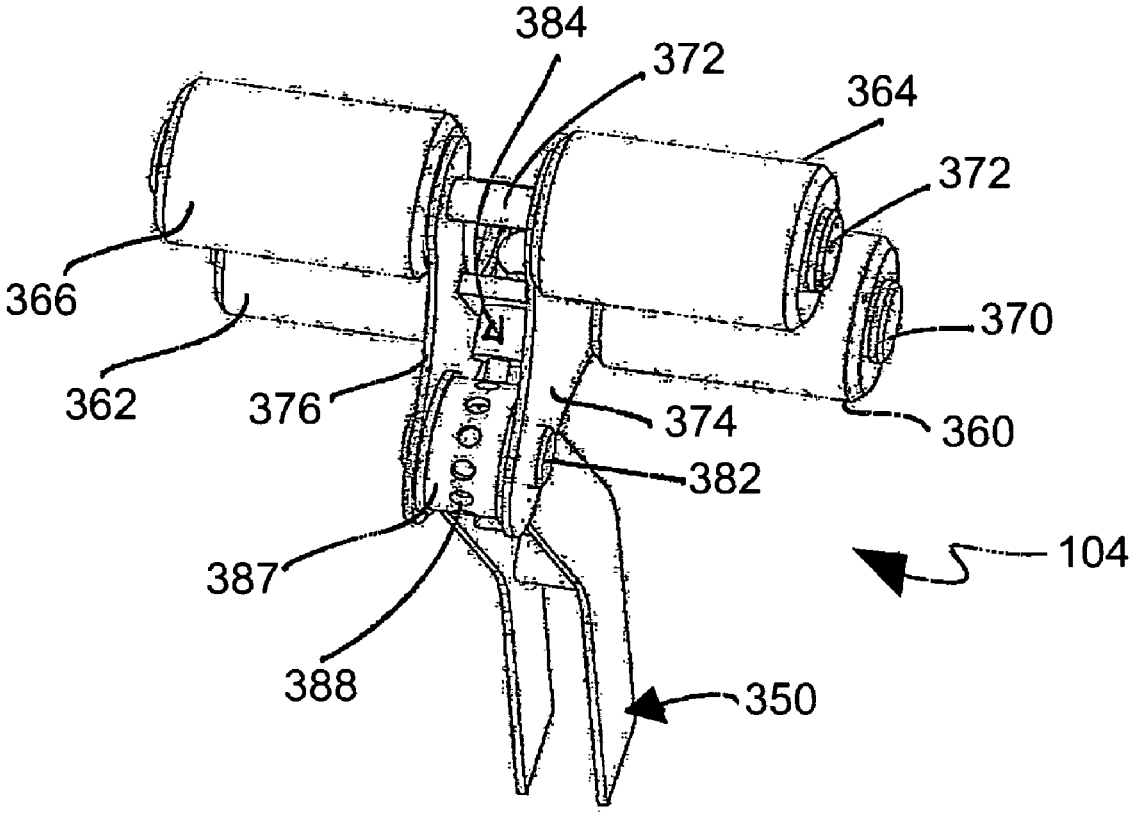
FIG. 7 is a perspective view of the foot support assembly.
Figure 8:
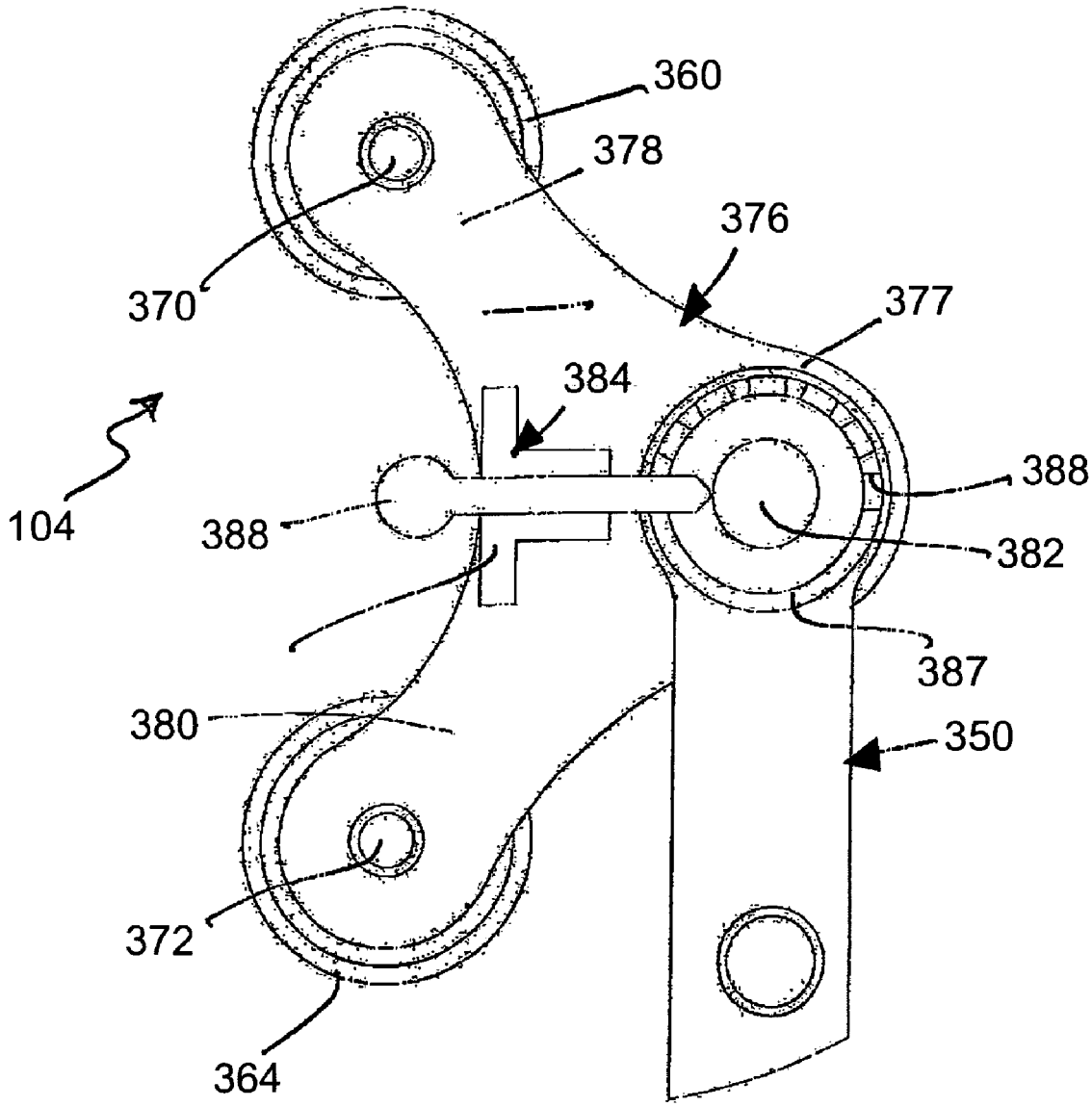
FIG. 8 is a diagrammatic partial cross-sectional vie of the foot assembly.

The present ab bench also includes a novel foot assembly 104 that is shown in detail in FIGS. 7 and 8. It should be noted that this foot assembly can be used on this ab bench as well as on a variety of other types of exercise equipment where a foot holder or foot support would be useful.

The foot assembly 104 is located at an outer end 350 of the foot beam 250, and the foot assembly 104 can be positioned in a number of positions as is shown by the dotted arrow 352 in FIG. 1. In my '203 patent there was a movable foot section that was able to be raised and lowered, but the rotational movement was limited to six inches of movement between three positions, with that limited movement being slightly off line from the vertical and vertically centered on the leg end of the foot brace. Here the foot assembly is provided with a range of movement through about an arc ranging from about 120° to about 200°, with the preferred arc of movement being about 180 degrees as shown in FIG. 1 by the dotted line arrow. Thus, the foot assembly can face fully away from a bench user, as is shown in full line in FIG. 1, it can directly face the bench user, as is shown by the dotted line representation in FIG. 1. Similarly, the foot assembly 104 can be positioned at a number of intermediate positions there between. The foot assembly 104 includes four cylindrical foot cushions, 360, 362, 364 and 366, that are slidably mounted over and fixed to the opposing ends of cross beams 370 and 372 that extend outwardly through, and are supported by, a pair of mounting plates 374 and 376. In particular, plates 374 and 376 are shaped to include a lower portion 377 and a pair of obliquely extending mounting arms 378 and 380. Thus, the cross beams 370 and 372 and the foot cushions 360-366 that are supported thereby are supported by two pairs of outwardly extending arms 378 and 380. The lower portion 377 of each plate 374 and 376 is rotatably mounted at the outer end 350 of the foot beam 250 by a bolt and a pivot connection 382. A locking-pin assembly 384 is mounted between plates 374 and 376 via a welded holder 386, and cooperates with a circular ring 387 that is welded or otherwise fixed to the outer end 350. Ring 387 is provided with a plurality of circumferentially spaced apart holes in which the locking pin 388 can be received.

This foot assembly 104 provides a greater range of motion for the foot assembly than was previously possible, and allows the bench to better accommodate a wider range of user sizes so that users who are short, of an average size as well as taller users can all comfortably perform crunch type exercises on the bench. For example, with the foot assembly 104 positioned as shown in dotted line in FIG. 1, the foot assembly will be set at a position closest to the user lying on the bench. This setting will provide foot support and the best range of motion for a user whose height ranges from about 4.5 feet to about 5.5 feet. With the buttocks of a user resting on the seat 170, and the upper torso against the cushion 160, placing one's feet on the foot assembly 104 and within cushions 360-366, permits that shorter user to do crunches without undue strain on the lower back, on the cervical spine, the quadriceps or the ham string muscles. This multi-pivot foot system will help isolate the core abdominal muscle groups with acceptable strain on the other portions of the body.

While there are settings between full forward and vertical, when the foot assembly is positioned in a vertical facing position, half way through the arc of movement, the foot assembly 104 will be in a location suitable for a user who is about 5.5 feet tall to about 6 feet. With the foot assembly in the full back or the full line position shown in FIG. 1, the foot assembly will accommodate users taller than 6 feet. Here again, there are additional intermediate positions that can be set between the vertical and full rearward facing locations, and these intermediate settings will allow individual users to find the setting that most accommodates their individual size and height.

Figure 12:
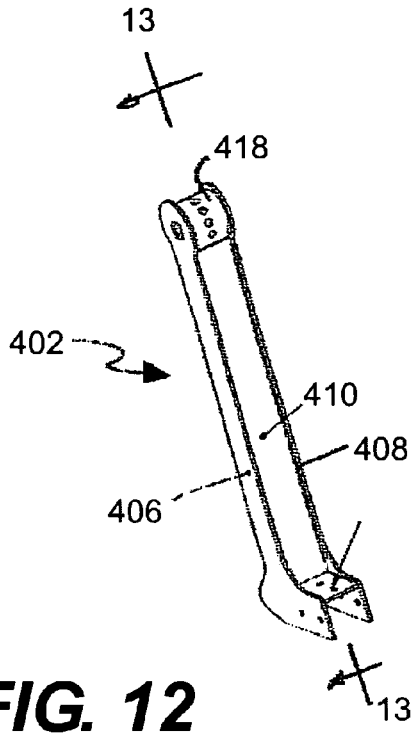
FIG. 12 is a perspective view of a portion of the multi-pivot foot system support tube.
Figure 13:
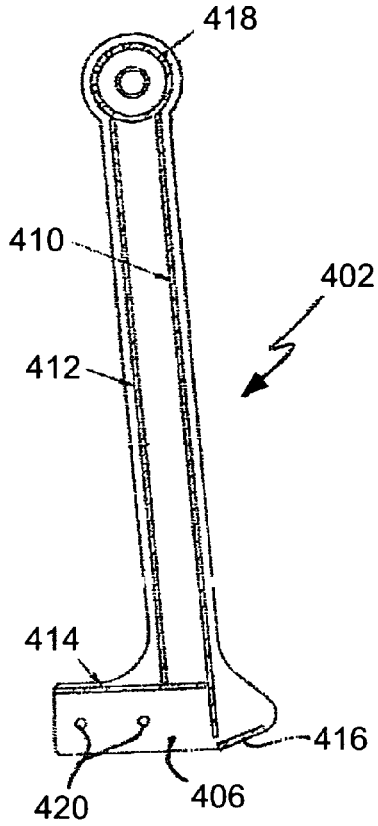
FIG. 13 is a cross-sectional view taken along line 13-13 in FIG. 12.

An alternative embodiment of the present invention relating to a modified support member for the foot assembly 104 is comprised of a modified, two piece foot beam 400 as shown in FIGS. 11-14. This foot beam 400 is comprised of an outer section 402 and an inner section 404 that will preferably be bolted together. The outer section 402 is constructed from two side panels 406 and 408 that are welded to a front panel 410 and a rear panel 412, as well as a bottom plate 414 and a brace or support plate 416. A multi-apertured positioning ring 418 is welded between side panels 406 and 408 at the top thereof. Also as shown in FIGS. 12 and 13 a plurality of bolt holes 420 are provided in both the bottom portion of side panels 406 and 408 and along the center of bottom plate 414.

The inner section 404 is comprised of a square tubular section 430 with a pivot tube 432, welded to one end of the tubular section 430, and a pair of joint plates 434 and 436 each of which is welded to the tubular section 430 and are provided with an aperture 438 and 440, respectively, that will allow an end of hitch plate 230 to be pivotally connected to the foot beam 400. As with the beam 250, the hitch member 230 interconnects the torso section 100 to the foot assembly 104 so that they operate in unison as the bench is used. In addition, a plurality of bolt holes 442 are provided adjacent the end of tubular section 430 opposite from pivot tube 432 so that holes 442 will align with holes 420 thereby permitting the inner section 404 to be bolted to the outer section 402.

To form the ab bench into a sit-up system it is possible and important to be able to disengage the foot assembly from the torso section. Thus, rather than having both the torso and foot assembly move together, or cooperatively, the torso section could move independently from the foot assembly.

Figure 15:
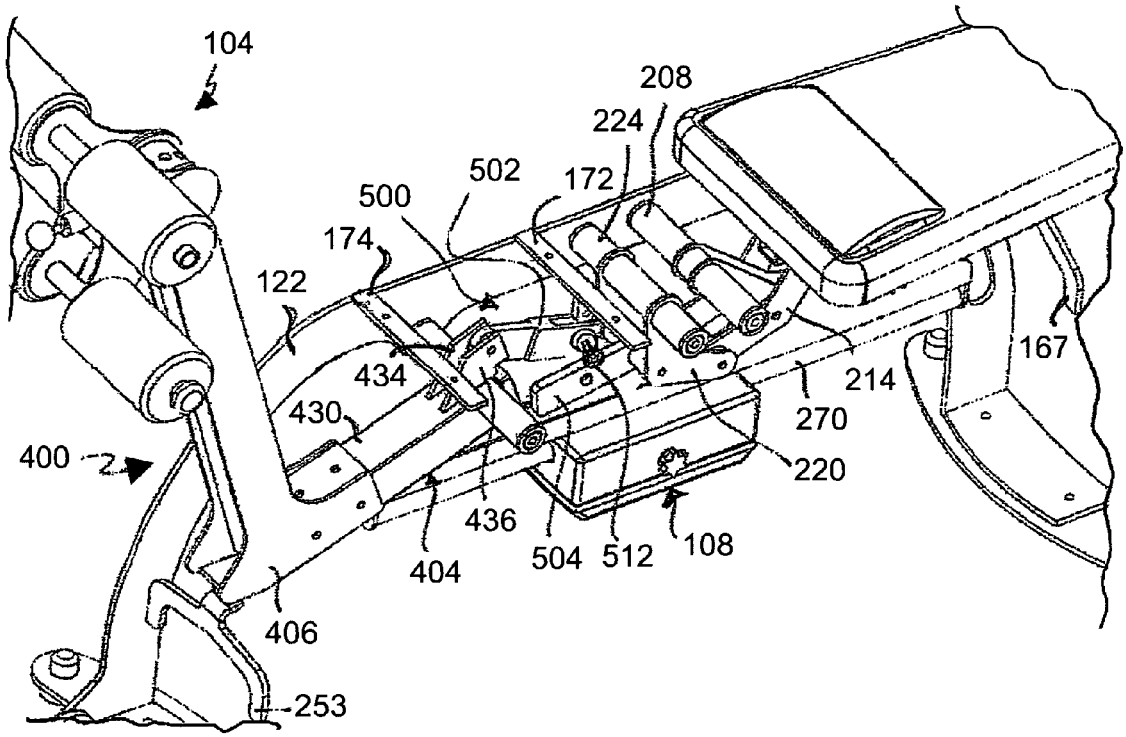
FIG. 15 is a perspective view showing a foot assembly disconnect feature.
Figure 16:
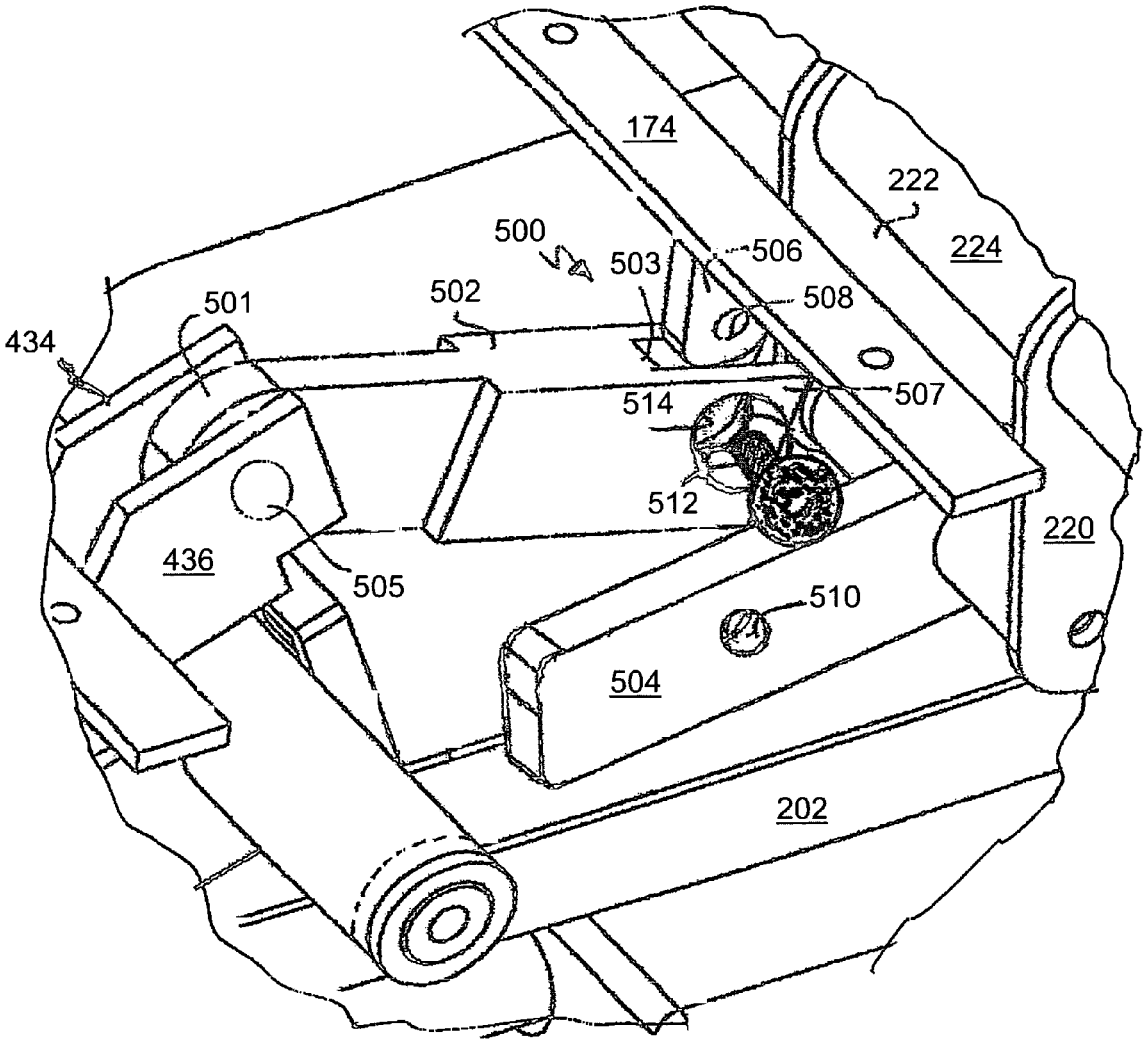
FIG. 16 is an enlarged view of a portion of FIG. 15.

FIGS. 15 and 16 show a modified foot assembly 500 connection to the torso assembly. This modified foot assembly 500 includes the same cushioned end of the foot assembly 104 shown in detail in FIGS. 7 and 8, and could include either the foot beam 250 of a first embodiment of the foot assembly, or the two piece mechanism comprised of the outer and inner sections, 402 and 404, respectively, of the second embodiment of the foot support. For convenience, the second embodiment is being referenced hereinafter to describe the modification of the connection to the frame and torso section 100.

The major modification is to replace the hitch member 230, which links the foot assembly 104 to the torso assembly, with a two piece structure. One of those pieces is a machined or formed member 502 having one end 501 pivotally connected between joint plates 4343 and 436 by a pin 505. The other end of member 502 includes a slot 503 defined between end pieces 507. The other piece of the two piece structure is a bar 504 pivotally connected to the center point 221 of boomerang links 220 and 222 by a cross-beam (not shown) that replaces beam 231. Bar 504 also includes an aperture 510. The end pieces 507 also include an aperture 514, shown in FIG. 15. A locking pin 512 is also provided for interconnecting member 502 and bar 504 by passing through apertures 510 and 514. When that arrangement exists, the foot assembly 500 will be connected to the torso section 100.

However, when locking pin 512 is removed from apertures 510 and 514, member 502 and bar 504 will be disconnected permitting bar 504 to drop downwardly into the position shown in FIG. 15 and permits member 502 to be raised upwardly so that slot 503 fits around a depending support member 506 that is welded to the retainer strap 174 and which includes aperture 508. Locking pin 512 can then be inserted into aperture 514 and through aperture 508 thereby locking member 502 to the bottom of retainer 174. This fully disengages the foot assembly 500 from the torso section 100 and permits a user to use only the torso section 100 together with the desired weight 108.

While the linkage assembly is shown as including a pair of links 210 and 211, a pair of boomerang links 214 and 216, and a separate set of boomerang links 220 and 222, it should be understood that each of these pairs of links could be comprised of only one link member, for example links 210, 214 and 220, rather than a pair of each of these link members. Where the main linkage member 202*a* is comprised of a single plate, such as 202*a*, then these single links would be used with the single plate 202*a*.

It is preferred to construct the bench from metal plate stock, for example 5/16ths for steel and 5/8 ths for resins and for aluminum castings the thickness would be about 1.2 inch, and metal components, including castings, aluminum castings, cast iron. However, there are many reinforced resins and plastic materials that could be used for specific parts or for that matter the entire bench where suitable weight and strength are provided. Where resin or plastic parts are to be used, suitable molds for their manufacture would have to be built and this is within the skill of one of ordinary skill in plastic and resin manufacturing procedures. In addition, it is preferred that the cross beams are about one inch tubes, and the pivot bearings are preferably as described above, so that each cross beam is a pivot tube with bearings at each end.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A variable resistance exercise bench including a frame on which a seat is mounted, an upper torso assembly, and a linkage assembly that pivotally attaches the upper torso assembly to the frame, the linkage assembly including a main linkage member that extend axially along the frame beneath the seat and torso assembly and comprises a single, plate member having a foot section and a head section that is pivotally connected directly to the frame, and at least two pivotal connections between the upper torso assembly and the head section, a separate link member that provides a pivotal interconnection between the frame and the linkage assembly, and a weight movably mounted on the main linkage member.

2. The variable resistance exercise bench as in claim 1 further including a foot assembly having an inner end that is pivotally attached to the frame, and an additional link member pivotally connected at one end to the inner end of the foot assembly and a second end pivotally connected to h central point on said sepatate link.

3. The variable resistance exercise bench as in claim 1 wherein the said at least two pivotal connections between the upper torso assembly and the head section comprises a first single link member pivotally connected at one end to a point approximately in the middle of the upper torso assembly and a forward portion of the head end and a second single link member pivotally connected at one end to a point adjacent the rear of the upper torso assembly and the head end at a point spaced rearwardly from the forward portion connection.

4. The variable resistance exercise bench as in claim 1 wherein the head section includes a rearwardly extending mounting arm that is pivotally connected to the frame.

5. The variable resistance exercise bench as in claim 4 wherein the mounting arm is positioned at an angle of about 45° relative to the foot section.

6. The variable resistance exercise bench as in claim 1 further including a foot assembly pivotally connected to the frame and pivotaily connected to the linkage assembly for cooperative movement with movement of the torso assembly.

7. The variable resistance exercise bench as in claim 1 wherein the main linkage member comprises a plurality of late members that are fixed together.

8. The variable resistance exercise bench as in claim 1 further including a weight comprised of a main weight member and a plurality of individual weight sections removably attached thereto.

9. The variable resistance exercise bench as in claim 1 wherein the weight is slidably connected on a support located beneath the main linkage member and includes a locking assembly that permits positioning along the support, the locking assembly comprising at least a first cylinder having an interior end shaped to correspond to the shape of the support, and an adjustment mechanism to lock the locking assembly by tightly engaging the shaped interior end against the support and to unlock the locking assembly by disengaging the shaped end from the support.

10. The variable resistance exercise device as in claim 2, wherein the foot assembly comprises a beam having an inner end conected to the additional link member and an outer end on which is mounted at least one Y-shaped mounting plate having three spaced apart connection arms with one connection arm of the Y-shaped plate pivotally attached to the outer end of the beam so as to be adjustable in a plurality of positions along an arc of travel ranging from about 120 degrdes to about 200 degrees, and a set of spaced apart foot support members attached to the remaining connection arms of the Y-shaped plate.

* * * * *